US007476004B2

(12) United States Patent
Chan

(10) Patent No.: US 7,476,004 B2
(45) Date of Patent: Jan. 13, 2009

(54) LED LIGHTING LAMP TUBE

(76) Inventor: Sze Keun Chan, 2301 Laurels Industrial Centre, 32 Tai Yau Street, San Po Kong, Kowloon, Hong Kong (CN)

( * ) Notice: Subject to any disclaimer, the term of this patent is extended or adjusted under 35 U.S.C. 154(b) by 0 days.

(21) Appl. No.: 11/841,090

(22) Filed: Aug. 20, 2007

(65) Prior Publication Data

US 2008/0037245 A1 Feb. 14, 2008

Related U.S. Application Data

(63) Continuation of application No. PCT/CN2006/000241, filed on Feb. 21, 2006.

(30) Foreign Application Priority Data

Feb. 21, 2005 (CN) ..... 2005 2 0002000

(51) Int. Cl.
*F21V 1/00* (2006.01)

(52) U.S. Cl. ..... 362/240; 362/239; 362/294

(58) Field of Classification Search ..... 362/239, 362/240, 294
See application file for complete search history.

(56) References Cited

U.S. PATENT DOCUMENTS

| | | | | |
|---|---|---|---|---|
| 6,283,612 | B1 * | 9/2001 | Hunter | 362/240 |
| 6,659,622 | B2 * | 12/2003 | Katogi et al. | 362/219 |
| 6,997,576 | B1 * | 2/2006 | Lodhie et al. | 362/240 |
| 7,293,898 | B2 * | 11/2007 | Kumthampinij et al. | 362/294 |
| 7,314,291 | B2 * | 1/2008 | Tain et al. | 362/294 |
| 7,334,918 | B2 * | 2/2008 | Newton et al. | 362/239 |

* cited by examiner

*Primary Examiner*—Sandra O'Shea
*Assistant Examiner*—James W Cranson
(74) *Attorney, Agent, or Firm*—McNeely Bodendorf LLP; Kevin J. McNeely

(57) ABSTRACT

A LED lighting lamp tube comprises a transparent tube body, lamp caps, electrode pins, pedestals mounted at the connection position of the transparent tube body and the lamp caps, a power supply converter located adjacent to the lamp caps and inside the tube body, a PCB and a plurality of LED mounted on the PCB. These LED are connected in parallel or in series, and a light-scattering plate may be disposed over these LED. A plurality of LED chips can be directly mounted on the light-scattering plate. The lamp caps and the electrode pins possess the same international standards as common lamp tubes.

12 Claims, 4 Drawing Sheets

LED LIGHTING LAMP TUBE

CROSS REFERENCE TO RELATED APPLICATIONS

This application is a continuation of international patent application PCT/CN2006/000241 filed on Feb. 21, 2006, and claims priority to Chinese patent application 200520002000.1 filed on Feb. 21, 2005, which are incorporated by reference herein.

TECHNICAL FIELD

This invention relates to a light emitting diode (LED) lighting lamp tube and more particularly to a lamp tube which uses LEDs as its lighting source and which can replace generic fluorescent lamp tubes.

BACKGROUND ART

A daylight or fluorescent lamp tube typically uses a filament or collided argon ionization as a heater, vaporizing the mercury to emit strong ultraviolet rays, and emitting white light through fluorescence powder inside the tube. The present fluorescent lamp tubes can have certain shortcomings such as a short life time, easily broken filaments, flickering light that causes eye strain and some ultraviolet radiation. Moreover, the ends of tube can turn black after some time thereby limiting the light output. LEDs (light-emitting diodes) have a longer life time, high lighting output, no radiation. They are also shock resistant and have low power consumption. Thus it is green, power-saving and environment-protective lighting. Thus a need exist to introduce LEDs as ordinary lighting, especially for replacing the generic fluorescent lamp tube, bulb or other lighting equipment.

SUMMARY

It is, therefore, an objective to provide a lighting lamp tube, which uses LEDs as its lighting source in order to provide a high lumen output, long life time, power saving lighting lamp tube, which can replace a generic fluorescent lamp tube or other lighting or decorative lamp tube, without change to the physical configuration of the fluorescent lamp fixture.

In one general aspect, these objects are accomplished by a transparent tube body, lamp caps, electrode pins, pedestals mounted at the connection position of the transparent tube body and the lamp caps, a power supply converter located adjacent to the lamp caps and inside the tube body, a printed circuit board (PC)B and a plurality of LEDs mounted on the PCB. These LED are connected in parallel or in series. The number of LEDs depend on desired brightness, for example, the brightness of a 100 Watt generic lamp tube will need 120 LEDs, with 7-8 Watts of power consumption. The required color can be sent out with the arrangement of different color of LED in the transparent tube. In addition, the LED chips can be processed and embedded directly on the surface of the PCB to emit light.

The lamp caps and electrode pins use the same physical configuration as required under international standards for fluorescent lamp tubes and fluorescent lamp fixtures. The electricity goes through electrode pins to a power supply converter is converted into direct current, providing the power to the LEDs.

The power supply converter is installed adjacent to one of the lamp caps inside the tube. The input of converter is connected with electrode pins and the electricity will go to LED power supply circuit after converting to direct current. LED will emit light. The power supply converter can also be installed adjacent to both of the lamp caps inside the tube, each converter will provide direct current to a certain number of LEDs. The lamp cap can also be equipped with an automatic intelligent electric sensor.

The PCB with LED is mounted on pedestals at the two ends of the tube.

In another aspect, the tube and radiator pedestal are processed to combine together, with the power supply converter installed inside the tube. The PCB with LEDs is on the radiator pedestal and the power supply converter is connected by a power cord. The radiator pedestal is made of heat conductive material.

In a further aspect, the lighting lamp tube is made of transparent or translucent material, like glass, etc. It can protect the LEDs against moisture, and it can help stabilize the structure while letting light pass through. The tube body can be processed to have a convex-concave inner surface and smooth outer surface to facilitate scattering of light. In this way, the light from LED can be scattered into different angles through convex & concave inner surface to get an even light distribution. At the same time, it solves the focus and small angle issues resulting from LED light beams, and it increases the angular range to make it meet the requirement of generic lighting sources.

The astigmatism plate is made of transparent or sub transparent material. LED or LED chips can be integrated on or in the astigmatism plate to acquire even lighting.

LEDs housed in a transparent or translucent tube provide a high lumen output relative to energy consumption. They do not need a filament or fluorescence and do not emit ultraviolet radiation. In addition, the lighting tube product has the same interface structure as current fluorescent lamp tubes, so it is only necessary to replace the tube instead of other facilities.

For a better understanding of the invention, the objects, characteristics and advantages of the invention are illustrated in details through drawings and the written description.

Figure 1:
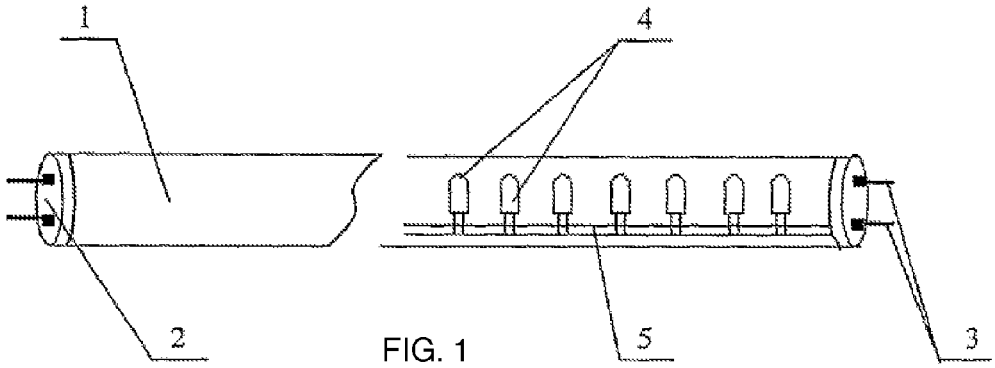
FIG. 1 is a perspective view of the LED lighting lamp tube.

In the drawings, 1 is a transparent tube body; 2 is a lamp cap; 3 are electrode pins; 4 are LEDs; 5 is a PCB; 6 is a pedestal; 7 is a power supply converter; 8 is a radiator pedestal; 9 is a power cord; 10 is a fastener; 11 is a convex-concave inner surface; 12 is a light-scattering plate; 41 are LED chips; 42 is a down-lead; 43 is a radiator plate; 81 is a radiator leaf; and 82 is a heat conductive insulator.

DETAILED DESCRIPTION

As shown in FIGS. 1 and 2, the LED lighting lamp tube comprises a transparent tube body (1), lamp caps (2), electrode pins (3), pedestals (6) mounted at the connection position of the transparent tube body (1) and the lamp caps (2), a power supply converter (7) located adjacent to the lamp caps (2) and inside the tube body (1), a PCB (5) and a plurality of LEDs (4) mounted on the PCB (5). The number of LEDs (4) is depended on needed brightness, for example, the brightness of a 100 Watt generic lamp tube will need 120 LED, with a 7-8 Watt of power consumption. A particular light color can be achieved by colored LEDs (4) in the transparent tube.

Figure 2A:
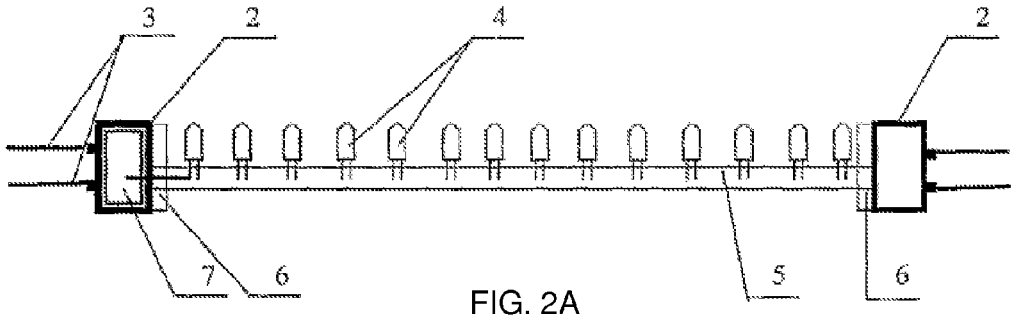
FIGS. 2A and 2B are structural views of the LED lighting lamp tube.
Figure 2B:
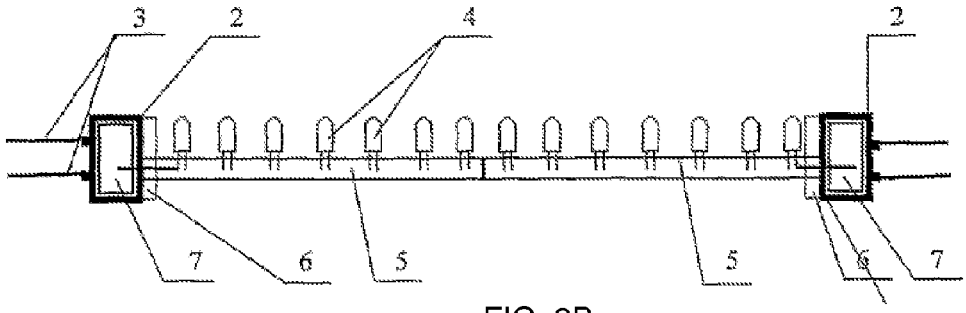
Figure 4:
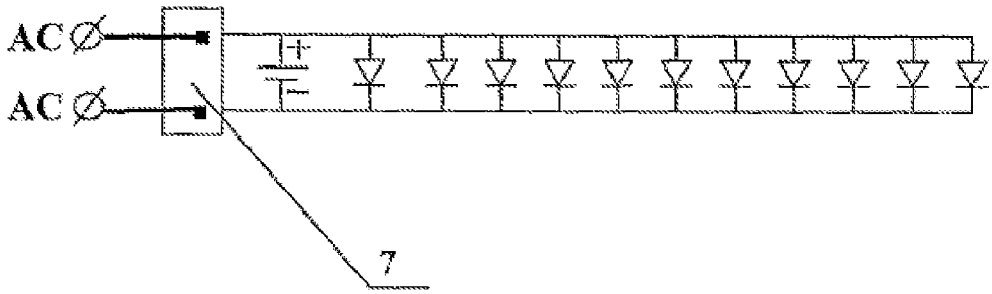
FIG. 4 is an electrical connection diagram of the LED lighting lamp tube.

As shown in FIGS. 2A and 4, the power supply converter (7) is installed adjacent to one of the lamp caps (2) inside the tube (1). The input of converter (7) is connected with electrode pins (3) and the electricity will go to the LED (4) power supply circuit after conversion to direct current. The LEDs (4) emit light to illuminate the space around the tube. In FIG. 2B, the power supply converter (7) can also be installed adjacent to both of the lamp caps (2) inside the tube, each converter (7) will provide direct current to a certain number of LEDs (4).

In FIGS. 2A and 2B, the PCB (5) have LEDs mounted on pedestals (6) at the two ends of the tube.

The lamp caps (2) are made of heat conductive material. The PCB (5) can be replaced by heat conductive PCB.

Figure 3:
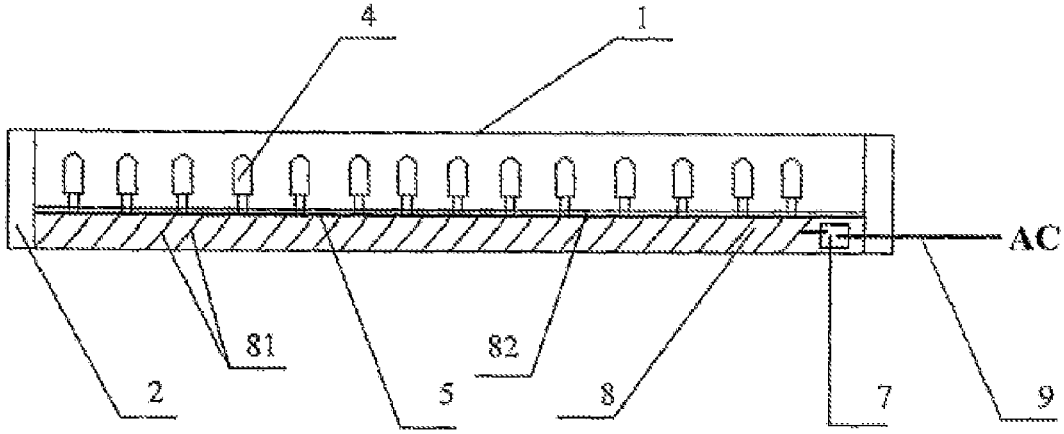
FIG. 3 is a structural view of another version of the LED lighting lamp tube.

In the embodiment shown in FIG. 3, the transparent tube (1) and radiator pedestal (8) are secured together by fastener (10), with a power supply converter installed inside. The PCB (5) with LEDs is on radiator pedestal (8), and LEDs (4) mounted on the PCB (5) are connected in parallel or in series. The power supply converter (7) is installed in the radiator pedestal (8), with its input is connected with power cord (9) and its output is connected with LED (4) electro circuit.

The radiator pedestal (8) is made of heat conductive material with radiator leafs (81) inside. Spacing is left between leafs to ensure better heat dispersion. The heat conductive insulator (82) is covered on the top of radiator pedestal (8)

Figure 5A:
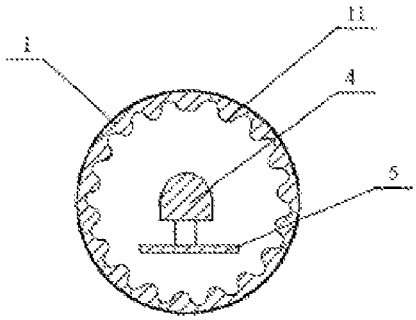
FIGS. 5A and 5B are cross-section views of two versions of the LED lighting lamp tube.
Figure 5B:
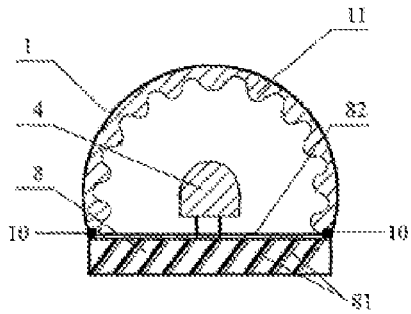

As shown in FIGS. 1 and 5, the lighting lamp tube (1) is made of transparent or translucent material, such as glass, etc. It can protect the LEDs (4) against moisture, adds stability to the structure and allows light to pass through. The tube body (1) can be processed to have a convex-concave inner surface (11) and smooth outer surface to facilitate light dispersion. In this way, the light from the LED (4) is dispersed at different angles through convex & concave inner surface (11) to get uniform distribution of light. Thus, the otherwise narrowly focused light beams are dispersed and distributed more evenly to meet the requirement of a general purpose lighting source.

Figure 6A:
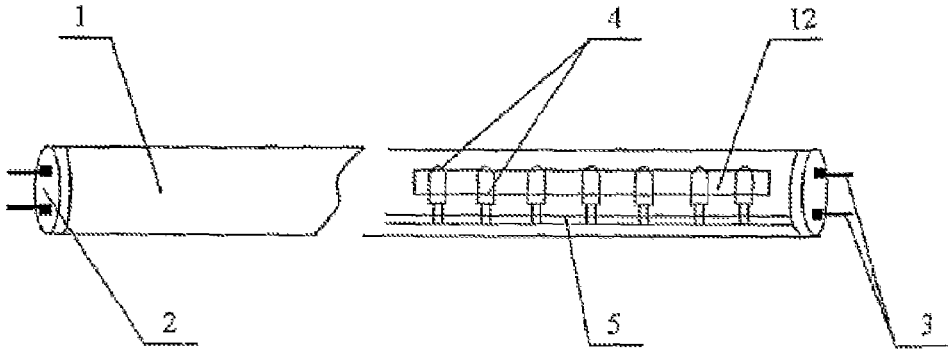
FIGS. 6A and 6B are views of two versions of light-scattering plates of the LED lighting lamp tube.
Figure 6B:
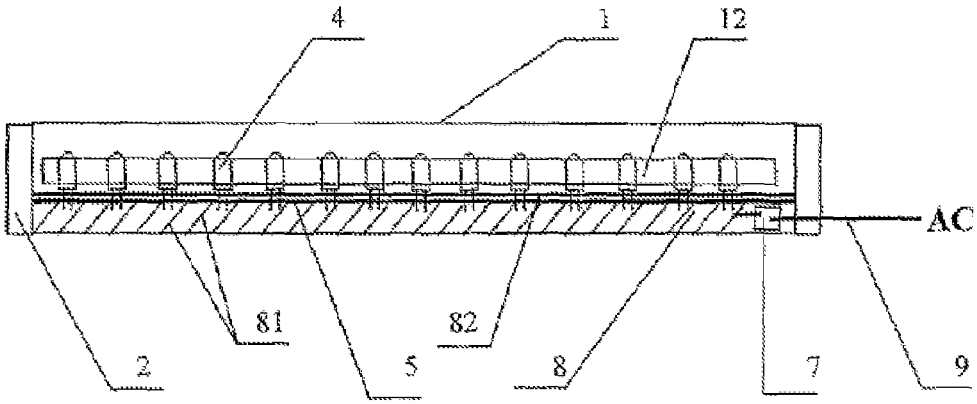

As shown in FIG. 6, light-scattering plate (12) may be disposed around the LED (4) to emit a more evenly distributed lighting pattern.

Figure 7A:
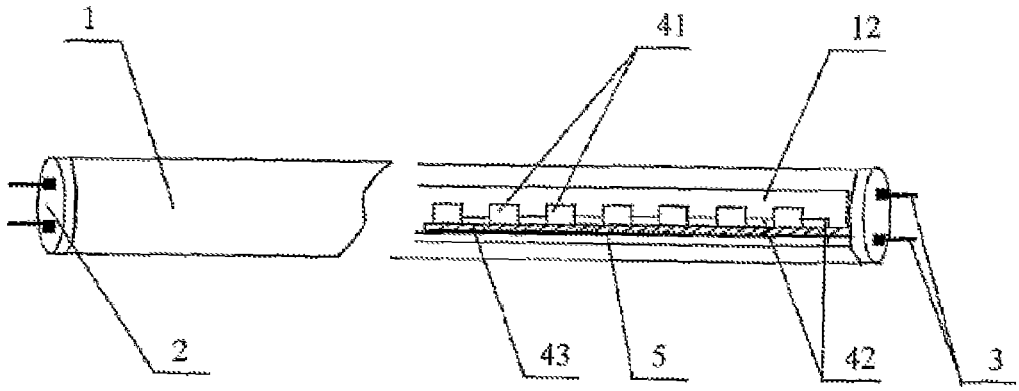
FIGS. 7A and 7B are views of versions of LED chips embedded in light-scattering plates of the LED lighting lamp tube.
Figure 7B:
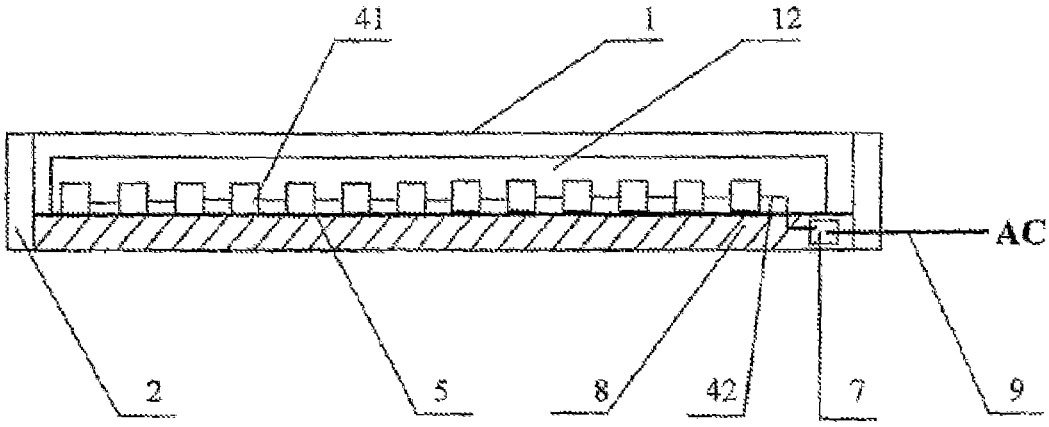

As shown in FIG. 7*a*, the LEDs (4) can be replaced by LED chips (41), which can be processed and embedded into the light-scattering plate (12). A plurality of LED chips (41) can be connected to the PCB (5) by down-lead (42). The light-scattering plate (12) has a radiator plate (43) under it, the LED chips (41) are installed on the radiator plate (43) or radiator pedestal (8). As shown in FIG. 7*b*, PCB (5) and radiator pedestal (8) are attached together and thus the heat from high power LED chips (41) can be dispersed in a timely manner.

While there have been shown and described what are at present considered to be some of the embodiments of the invention, it will be apparent to those skilled in the art that various changes and modification can be made herein without departing from the scope of the invention as defined by the following claims. The product can use a relatively simple structure and material, which caters to large scale production and has the prospect to easily replace present fluorescent lamp tubes and other lighting lamp tubes.

The invention claimed is:

1. A light emitting diode (LED) lighting tube, comprising:
a transparent tube body;
lamp caps at ends of the body;
electrode pins protruding from the lamp caps;
pedestals mounted at a junction of the transparent tube body and the lamp caps;
a power supply converter located adjacent to the lamp caps and inside the tube body;
a printed circuit board (PCB) inside the tube body and secured to the pedestals;
a plurality of LEDs connected in series or parallel and mounted on the PCB;
a power supply converter connected between the electrode pins and the PCB to provide direct current voltage to the LEDs; and
a light-scattering plate disposed around the LEDs;
wherein the LEDs comprise LED chips embedded into the light-scattering plate.

2. The LED lighting lamp tube of claim 1, further comprising:
a radiator plate under the light scattering plate,
wherein the LEDs comprise LED chips installed on the radiator plate.

3. An LED lighting lamp tube, comprising:
a transparent tube body;
lamp caps at ends of the body;
one or more radiator pedestal attached to the tube body proximate to the lamp caps, the one or more radiator pedestal having a series of radiator leafs at spaced intervals;
a power supply converter located adjacent to the lamp caps and inside the tube body;
a printed circuit board (PCB) inside the tube body and secured to the one or more radiator pedestal;
a plurality of LEDs connected in series or parallel and mounted on the PCB; and
a power supply converter connected between a power cord and the PCB to provide direct current voltage to the LEDs.

4. The LED lighting lamp tube of claim 3, wherein the power supply converter is installed in either one or both of the lamp caps.

5. The LED lighting lamp tube of claim 3, wherein the lamp caps are made of heat conductive material.

6. The LED lighting lamp tube of claim 3, wherein the tube body is made of transparent or translucent materials.

7. The LED lighting lamp tube of claim 3, wherein an inner surface of the tube body comprises a wave-like shape with convex and concave portions.

8. The LED lighting lamp tube of claim 3, wherein an outer surface of the tube body comprises a smooth shape.

9. The LED lighting lamp tube of claim 3, further comprising:
a light-scattering plate disposed around the LEDs.

10. The LED lighting lamp tube of claim 3, further comprising:
a light-scattering plate disposed around the LEDs.

11. The LED lighting lamp tube of claim 10, wherein the LEDs comprise LED chips embedded into the light-scattering plate.

12. The LED lighting lamp tube of claim 10, further comprising:
a radiator plate under the light scattering plate,
wherein the LEDs comprise LED chips installed on the radiator plate.

* * * * *